US006053255A

United States Patent [19]

Crain

[11] Patent Number: 6,053,255

[45] Date of Patent: Apr. 25, 2000

[54] BLOWOUT PREVENTER LIFT APPARATUS AND METHOD

[75] Inventor: Jack A. Crain, 107 Fabiola, Lafayette, La. 70508

[73] Assignee: Jack A. Crain, Broussard, La.

[21] Appl. No.: 09/103,209

[22] Filed: Jun. 23, 1998

[51] Int. Cl.[7] ..... E21B 19/02; B66F 1/00

[52] U.S. Cl. ..... 166/385; 166/77.51; 254/386

[58] Field of Search ..... 166/381, 382, 166/385, 85.4, 85.5, 77.51; 254/386, 385

[56] References Cited

U.S. PATENT DOCUMENTS 4,039,086 8/1977 Ray ..... 212/47

5,467,833 11/1995 Crain ..... 175/52

5,816,565 10/1998 McGuffin ..... 254/386

*Primary Examiner*—Frank S. Tsay

*Attorney, Agent, or Firm*—Baker Botts L.L.P.

[57] ABSTRACT

Apparatus and method for lifting blowout preventers beneath the floor of a drilling rig are provided. More than one cable is used on the drums of winches, allowing the winches to be compact enough for use on a drilling rig floor while avoiding the requirement for larger cable that would be required to achieve the high safety factors needed. The cables or wire ropes on the winches are attached to a member from which a larger diameter, higher strength intermediate cable is also attached. The intermediate cable is then attached to known apparatus such as a cradle for lifting a blowout preventer stack.

10 Claims, 2 Drawing Sheets

BLOWOUT PREVENTER LIFT APPARATUS AND METHOD

BACKGROUND OF THE INVENTION

1. Field of the Invention

This invention relates to drilling of wells. More particularly, improved apparatus and method for lifting blowout preventers below the floor of a drilling rig are disclosed.

2. Description of Related Art

As part of the process of drilling wells in the earth, joints of pipe called "casing" are joined and placed in a hole drilled to a first intermediate depth to form a casing "string." Cement is pumped between the casing string and the wall of the hole to mechanically hold the casing in place and prevent flow outside the casing. The well is then drilled deeper through this string of casing. Before drilling begins through the casing, blowout preventers are attached to the top of the casing. The purpose of the blowout preventers is to seal the top of the casing should excess pressure be encountered when drilling the well deeper.

In land drilling rigs, a blowout preventer stack extends from the top of the casing upward for about 10 to 20 feet above the ground surface or the casing. The floor of the drilling rig is elevated on a substructure sufficiently that the floor of the rig is above the top of the blowout preventer stack. This stack may include several blowout preventers, which are selected to achieve a seal at the top of the well under a variety of drilling conditions. When another string of casing is placed in the well through the first string and down to an intermediate depth or to the total depth of the well, it is necessary to remove the blowout preventer stack and cut the top of the additional casing near the earth's surface. A stack of blowout preventers may weigh more than 50 tons.

It is known to use a compact winch unit placed upon the floor of the drilling rig, specifically on the rotary table, which is placed in an opening of the rig floor, to lift blowout preventers. Such compact winch units are disclosed and claimed in U.S. Pat. No. 4,305,467 (the '467 patent). This patent describes the placement of two winches on a base frame, positioning the base frame on the rotary table of a rig and lifting blowout preventers by the winches. Cables (also called "wire ropes" or "ropes") are present on the drums of the winches. The cables are preferably sized to have sufficient strength to lift blowout preventers and maintain an adequate safety factor. The '467 patent states (Col. 12) "In order to minimize the danger of breakage of the cables 56, 58, such cables are selected to have a breaking strength considerably larger than the weight of a blowout preventer."

The breaking strength of cables or wire ropes depends on their diameter. For example, according to a brochure from Delta Wire Rope, steel core wire rope in the 6×19 class made from improved plow steel and having a diameter of 1 inch has a minimum breaking strength of 51.7 tons. For a diameter of 1⅛ inches, the minimum breaking strength is 65 tons. Although higher breaking strength can be achieved by use of larger diameter cable, the size drum which must be used to avoid excessive bending of the cable also increases with diameter of the cable. If larger diameter drums are used, placement of the winches on the floor of the drilling rig becomes increasingly difficult or, in some cases, impossible. The minimum size drum for 1⅛ inch wire rope, for example, is 14 inches. To increase the breaking strength of the wire rope from 65 tons to 132 tons, the size of the wire rope must be increased from 1⅛ inch to 1¹⁵⁄₈ inch. This would require an increase in drum size from about 14 inches to about 26 inches, which is often not practical, because there is not enough room on the rig floor.

What is needed is apparatus to achieve a higher safety factor with wire ropes on winch apparatus used for lifting blowout preventers and which can be as compact as presently used winches. Procedure for adapting prior art apparatus and operating cables on winches to achieve the higher safety factor is also needed.

SUMMARY OF THE INVENTION

Apparatus and method are disclosed for multiplying the safety factor of wire rope used on winch apparatus used in lifting blowout preventers below the floor of a drilling rig without increasing the size of the winch drums. Multiple segments of cable, called winch cables, are placed on each of the drums of the winch units. A divider is preferably placed on the drums between the segments of cable. The free end of each segment of cable is attached to one side of a common member such as a crossbar. Attached to the opposite side of the common member is a cable having larger diameter than the winch cables, preferably with a minimum break strength approximately equal to the combined break strength of the multiple cables extending from the winch unit. The free end of the larger diameter cable may then be attached to a shackle and thereby to a cradle which is placed on a blowout preventer stack for lifting.

DETAILED DESCRIPTION OF THE INVENTION

Figure 1:
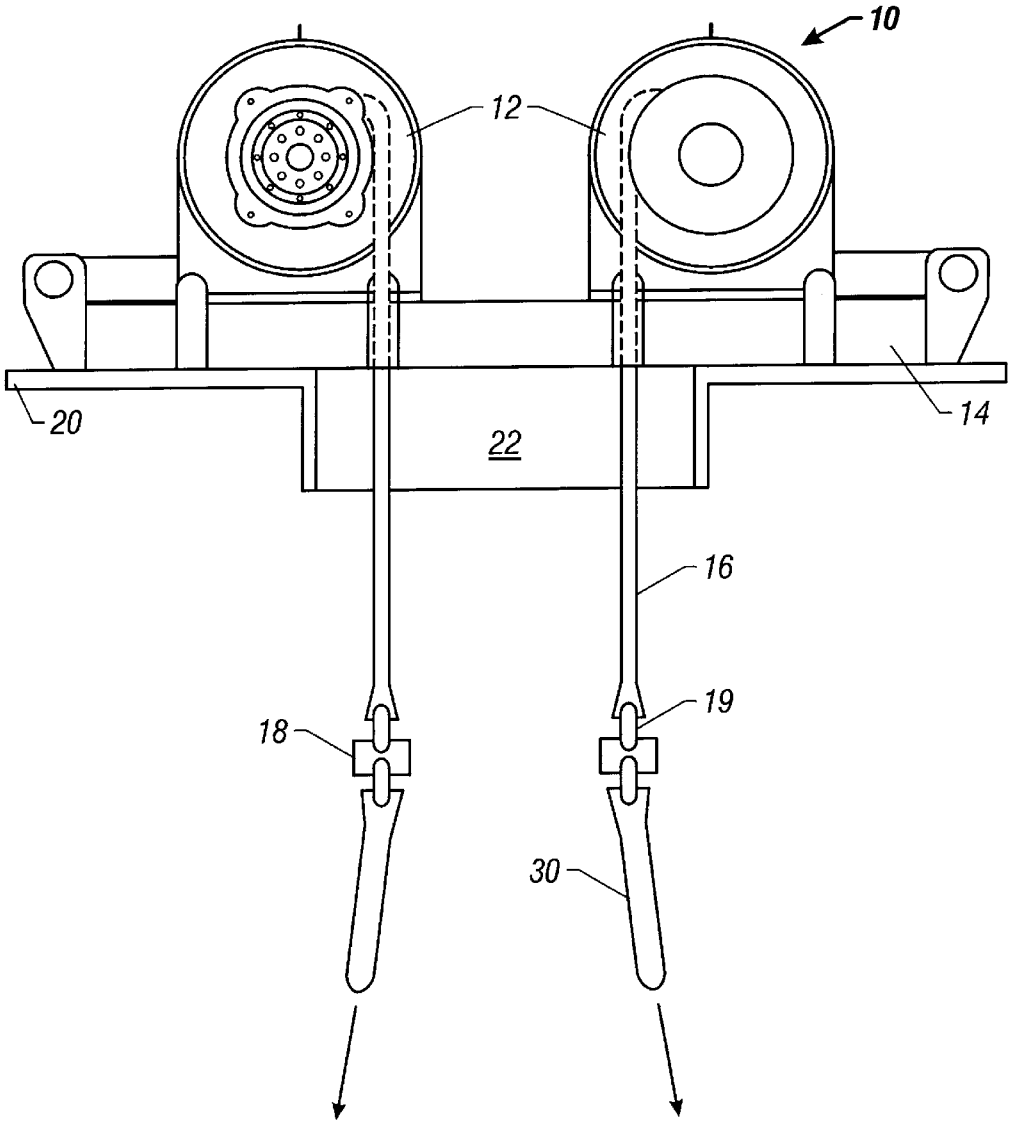
FIG. 1 is a cross-section side view of the apparatus of this invention showing ropes extending from each drum of the blowout preventer lifting apparatus.

Referring to FIG. 1, apparatus for lifting blowout preventers which is a modification of apparatus such as shown in U.S. Pat. No. 4,305,467, is shown at 10. U.S. Pat. No. 4,305,467 in incorporated by reference herein. Such apparatus includes drums 12 for receiving and holding cables or wire ropes 16, which are herein designated "winch cables." Drums are mounted on base support 14. Apparatus 10 is placed on drill floor 20 and appropriately centered over opening 22 extending through floor 20. Floor 20 is supported by a substructure (not shown) of a drilling rig. Opening 22 may be the opening left after removal of the master bushing of a rotary table or may be the opening through a master bushing, for example. Cables 16 are attached to common member 18 which is shown as a crossbar with tabs 19. Alternatively, common member may be a ring or other member designed for attachment of multiple cables. Winch cables 16 have a diameter small enough to be placed on drum 12 without undue wear or stress to rope 16. Means for fastening wire ropes 16 to tabs 19 so as to avoid high stress on the wire ropes are well known in the art. Crossbar or other common member 18 is sized to support the maximum loads with safety factors to be employed in operation of apparatus 10. Also attached to the opposite side of crossbars 18 are intermediate cables 30 ("intermediate" between the winch cables and the blowout preventer cradle). Intermediate cables 30 have a larger diameter than winch cable 16. Ropes 30 preferably will support the total combined load of ropes 16 which are attached to crossbar 18. Winch cable 16 is preferably swaged with a stop button on one end and a two-inch solid thimble on the other end. Intermediate cable 30 may be about 15 feet long with standard eyes at both ends.

Figure 2:
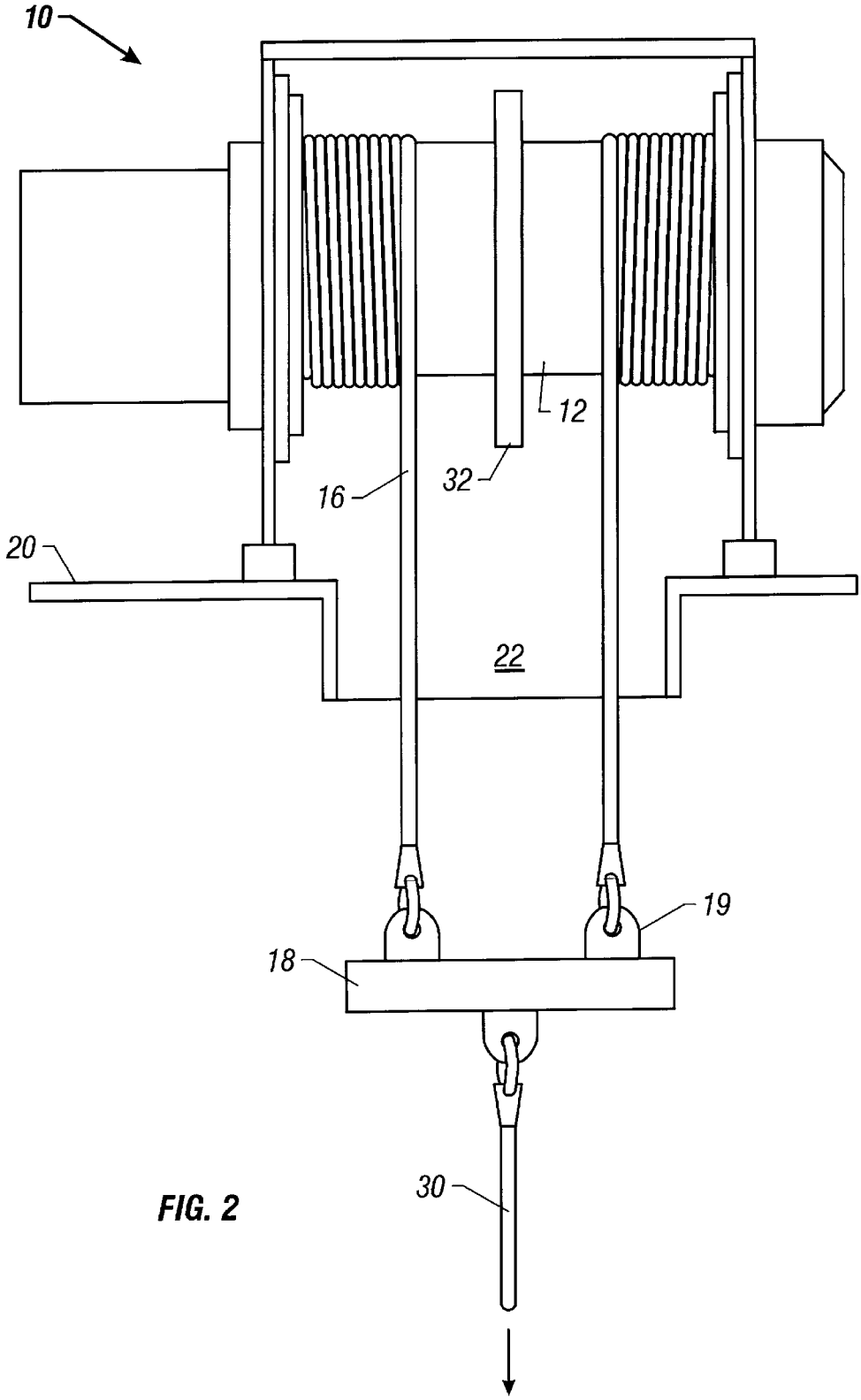
FIG. 2 is an end view of one of the winch units of FIG. 1 and a common member with attached cables.

Referring to FIG. 2, a horizontal end view of a winch and common member (90° removed from the view of FIG. 1) is shown. It is seen that more than one cable 16 is placed upon drum 12. Each rope is attached to crossbar 18 by tabs 19. Wire ropes may be separated on drum 12 by divider 32 to insure no overlap of different segments of wire rope. Only two segments of winch cable 16 are shown, however multiple dividers 32 can be placed upon drum 12 and more than two segments of cable can be placed on each drum. This procedure can be used to provide added safety factor to the apparatus or to allow use of smaller diameter wire rope. The length of crossbar 18 is sized so as to pass through opening 22.

Divider 32 may be added to conventional drum 12. The divider may be welded or attached by bolts or other fastener. Apparatus such as described in U.S. Pat. No. 4,305,467 may be adapted to include divider 32 and accommodate multiple segments of wire rope 16. Wire rope 30 may extend to a shackle (not shown) upon which a cradle for lifting a blowout preventer stack may be attached. Such procedures are well known in the art.

As an example of the advantages of this invention, consider the following. Because of workspace limitations, the drum diameter of a winch such as illustrated in FIGS. 1 and 2 is restricted to wire rope having a diameter of 1¼ inches. The company supplying the winch unit for lifting a blowout preventer stack is using 1¼ inch 6×19 class cable that has a minimum break strength of 80 tons, and there is one segment of wire rope on each winch. The winch unit is to be used to lift a blowout preventer stack weighing 65 tons. The safety factor in using this wire rope then is only 160/65=about 2.5. Because of high potential for damage to equipment and personnel, a higher safety factor is desired. The company supplying the winch unit then adds a divider to the drums of the winches, as shown in FIG. 2, and places two segments of the same diameter wire rope on each winch. A crossbar is attached at the end of these wire ropes from each winch and a 1⅞ inch cable of the same type is attached to the opposite side of the crossbar as shown in FIG. 2. The larger cable has a break strength of 174 tons, which is greater than the break strength of the two ¼ inch cables supporting the crossbar. The safety factor for lifting a 65 ton blowout preventer stack has been increased from about 2.5 to about 5, which greatly reduces the risk of damage to personnel or equipment.

Although the description herein has referred to the blowout preventer system described in U.S. Pat. No. 4,305,467, it should be understood that other forms of winch apparatus for lifting loads through an opening in the floor of a drilling rig can benefit from the apparatus and method of this invention. For example, a single winch unit may be used instead of the two winches shown in FIG. 1. A base frame for the winch units may not be necessary if the winches are otherwise fixed to the floor of a drilling rig.

The invention has been described as to its preferred embodiments. Those of skill in the art may, upon reading this disclosure, appreciate changes or modifications which do not depart from the scope and spirit of the invention as described above or claimed hereafter.

What I claim is:

1. Apparatus for lifting a blowout preventer beneath a floor of a drilling rig, comprising:

a first winch having a drum and being of such a size that the winch can be positioned on the floor and over an opening in the floor;

a plurality of segments of winch cable fastened to the drum of the first winch so as to be separately extendable and retractable when the winch is operated and having a first total combined breaking strength;

a first common member attached to the segments of winch cable; and means for connecting the first common member to the blowout preventer.

2. The apparatus of claim 1 further comprising a second winch having a drum and being of such a size that the winch can be positioned over the opening, a plurality of segments of winch cable fastened to the drum of the second winch so as to be separately extendable and retractable when the winch is operated and having a second combined total breaking strength, a second common member attached to the segments of winch cable and means for connecting the second common member to the blowout preventer.

3. The apparatus of claim 1 further comprising a divider on the drum of the first winch for preventing overlap of the segments of winch cable on the first winch.

4. The apparatus of claim 2 further comprising a divider on the drum of the second winch for preventing overlap of the segments of winch cable on the second winch.

5. The apparatus of claim 1 wherein the first common member is a crossbar.

6. The apparatus of claim 2 wherein the second common member is a crossbar.

7. The apparatus of claim 2 wherein the first and second winches are disposed on a base frame supportable on the floor of the drilling rig.

8. The apparatus of claim 2 wherein the means for connecting the first and second common members to the blowout preventer includes a first and second intermediate cable, each having a minimum breaking strength greater than the total combined breaking strength of the winch cables on each winch.

9. A method for lifting a blowout preventer stack beneath the floor of a drilling rig, the floor having an opening therethrough, comprising the steps of:

placing a first and a second winch on the floor, each winch having a drum with a plurality of winch cables attached thereto, the plurality of winch cables attached to each winch being extendable and retractable when each winch is operated, each winch cable having a minimum breaking strength and each plurality of winch wire ropes having a total combined minimum breaking strength;

attaching the plurality of winch cables from the first winch to a first common member and the plurality of winch cables from the second winch to a second common member;

attaching first and second segments of an intermediate cable to the first and second common members, the intermediate cables having a minimum breaking strength greater than the minimum breaking strength of each winch cable; and connecting the intermediate cables to the blowout preventer stack and operating the winches.

10. The method of claim 9 wherein the intermediate cables each have a minimum breaking strength at least as great as the total combined breaking strength of the plurality of winch cables on each winch.

* * * * *